US006701844B1

(12) United States Patent
Roy

(10) Patent No.: US 6,701,844 B1
(45) Date of Patent: Mar. 9, 2004

(54) CUSTOM LOGO PROCESS

(75) Inventor: Doreen K. Roy, Acushnet, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 10/412,430

(22) Filed: Apr. 14, 2003

(51) Int. Cl.[7] ..... B41M 1/14; B41F 31/00

(52) U.S. Cl. ..... 101/483; 101/DIG. 40; 101/211

(58) Field of Search ..... 101/483, 494, 101/211, 35, 41, DIG. 40

(56) References Cited

U.S. PATENT DOCUMENTS 5,778,793 A * 7/1998 Mello et al. ..... 101/494
6,276,266 B1 * 8/2001 Dietz et al. ..... 101/41
6,490,968 B2 * 12/2002 Lutz et al. ..... 101/35
2001/0036871 A1 * 11/2001 Lampinski et al. ..... 473/351
2002/0097280 A1 * 7/2002 Loper et al. ..... 347/2
2002/0100378 A1 * 8/2002 Dupuis ..... 101/135
2003/0121427 A1 * 7/2003 Lampinski et al. ..... 101/35

OTHER PUBLICATIONS

Dave Prochnow; In the Zone; digital Foto Aug. 2000.
Wayne J. Cosshall; Flipping Channels; digital Foto Apr. 2001.

* cited by examiner

*Primary Examiner*—Eugene H. Eickholt
(74) *Attorney, Agent, or Firm*—Swidler Berlin Shereff Friedman, LLP

(57) ABSTRACT

A method for placing an image onto an object is described. In a preferred embodiment, the method includes obtaining a first image. At least one region of the image may then be defined. Each defined region may then be manipulated as desired. After manipulating each region, a desired color may be added to each region to produce a second image. The second image may then be transferred onto a desired object.

12 Claims, 6 Drawing Sheets

QUANTUM
IMAGING

EXCLUSIVELY BY TITLEIST

CUSTOM LOGO PROCESS

FIELD OF THE INVENTION

The present invention relates to an improved color imaging process. More specifically, the present invention relates to an improved method for accurately printing color images on a golf ball.

BACKGROUND OF THE INVENTION

One traditional color printing process involves using a palette of multiple colors, referred to as process colors. One example of such a printing palette is CMYK. Using a combination of only four colors in a palette, any color can be created. These processes are typically used in everyday applications such as ink jet printers.

Using a palette of colors provides several advantages. For example, despite requiring only four different inks, a CMYK palette can create a large variety of colors. Because of this, a CMYK palette may be used to economically create high fidelity pictures. Traditional color printing processes have several disadvantages as well. For example, color consistency is often difficult to achieve. Typically, colors such as purple or yellow are difficult to accurately produce with a CMYK process. This can be a problem when a printing process is used to repeatedly print a large volume of pictures or designs. Typically, this is because consistent color repetition is difficult.

In professional photography applications, or applications where colors or designs must be accurately reproduced with optimal quality, traditional printing processes may not be suitable. Shading, for example, may be difficult using CMYK processes. In addition, CMYK requires a significant amount of trial and error to achieve a desired color. In high volume applications, or applications where there are strict color requirements, it may become prohibitively expensive to use this method of achieving correct color quality.

Another method of printing is referred to as a spot color process. This process is used for applications that typically involve up to five colors, where the overall image is separated into one or more regions with a color assigned to each region. Thus the color for each region is not created using a Euro process. A spot color process may be preferable in vector artwork applications, such as printing company logos that have a limited amount of colors or text, or when the color selected for the image may be difficult to accurately reproduce using a different process.

For some applications, an appearance of more colors than actually used to create an image may be obtained by varying the shade, screen, or tint of the spot colors. Moreover, the use of a gradient of the colors may help create a more realistic or improved quality image. The use of a gradient to improve spot color processes is further described in U.S. Pat. No. 5,778,793 to Mello, the entirety of which is incorporated herein.

One drawback of using a spot color process, however, is that it can be difficult to obtain a desired balance of color to accurately produce shading or create an image nearing photographic quality. As a result, using a spot color process can result in significant time and expense of trial and error in selecting a suitable color and balancing its use and tonality to create a desired effect.

In applications where a picture or design must be printed onto a three-dimensional surface, such as the curved surface of a golf ball, a pad printing process may be employed. The pad printing process is typically used because it is one of the most versatile printing processes due to its ability to print on three-dimensional objects and compound angles.

In a first step of the pad printing process, an image to be transferred is etched into a printing plate, commonly referred to as a cliché. Once mounted in a machine, the cliché may be flooded with ink. The surface of the cliché is then cleaned, leaving ink only in the image area. As solvents evaporate from the image area, the ink's ability to adhere to a transfer pad increases. Typically, the transfer pad is made out of silicone.

Next, the pad is positioned directly over the cliché, pressed onto it to pick up the ink, and then lifted away. The physical changes that take place in the ink between the time that the ink is placed in the cliché, and the time the pad picks up the ink, accounts for its ability to leave the cliché in favor of the pad.

After the pad has lifted away from the cliché, there is a delay before the ink is deposited on the object. During this stage, the ink has just enough adhesion to stick to the pad. In this stage, the ink can easily be wiped off, but it does not drip. The ink on the pad surface once again undergoes physical changes, i.e., solvents evaporate from the outer ink layer that is exposed to the atmosphere, making it tackier and more viscous.

The pad is pressed down onto the object, conforming to its shape and depositing the ink in a desired location. Even though the pad may compress considerably during this step, the contoured pad is designed to roll away from the object's surface, rather than press against it flatly. A properly designed pad avoids a zero degree contact angle with the object. Such a situation would trap air between the pad and the object, resulting in an incomplete transfer.

The pad then lifts away from the object and assumes its original shape, leaving all of the ink on the object. When the pad is pressed onto the object, the adhesion between the ink and the object is greater than the adhesion between the ink and the pad, resulting in a virtually complete deposit of the ink. This leaves the pad clean and ready for the next print cycle.

By combining the pad printing process with CMYK, or spot colors, a design or picture can be printed on many types of objects. However, a continuing need exists for a method for using the pad printing process to print color images onto objects precisely and accurately.

Methods for manipulating black and white images have been formulated in the past. One such method, called the Zone System, was invented by Ansel Adams in the 1930's. The Zone System allows a photographer to manipulate black and white images by adjusting three variables: CCD sensitivity; subject luminance; and exposure settings. By manipulating these three variables, a photographer can create an image that has increased contrast and visible details. This method is described in an article entitled "In the Zone", by Dave Prochnow (Dave Prochnow, "In the Zone," *Digital Foto*, August 2000, pp. 38–74).

Another method for manipulating black and white images is described by Wayne J. Cosshall in an article entitled "Flipping Channels". (Wayne J. Cosshall, "Flipping Channels,"*Digital Foto*, April 2001, pp. 70–72).The method uses red, green and blue filters to view an image. According to the method, one of the filtered images is chosen based on the aesthetic qualities of the picture. The pictures viewed through the other filters are discarded, and a user is left with a black and white picture that provides the optimum contrast. Despite the advances in manipulating black and white images, a continuing need exists for a method of printing manipulated color images onto a golfball.

SUMMARY OF THE INVENTION

The present invention is generally directed towards a method for placing an image onto an object. In one embodiment, an image should first be obtained. The obtained image may then be filtered using any method known to those skilled in the art. After filtering the image, a replica based on the filtered image may be created, and then transferred to the object.

In a preferred embodiment, the filtering may be done by using a set of filters such as CMYK filters. A replica may be created by defining at least one region on an image. For each region, one of the filtered images may be chosen. The chosen filtered image may be manipulated and then assigned at least one color. In some embodiments, an image may be manipulated by varying characteristics such as shading, gradient, contrast, opacity, and tone.

Preferably, the image is transferred onto an object using a printing process known to those skilled in the art. In one embodiment, this printing process comprises a pad printing process. Preferably, the pad printing process is used to print the image onto an object such as a golf ball. However, in other embodiments, other objects may be used.

In another embodiment, the present invention comprises a method for placing an image onto an object by first obtaining an image. In this embodiment, at least one region is defined and then manipulated. At least one color is assigned to each of the manipulated regions to produce a second image. This second image is then printed onto an object, preferably a golf ball.

DETAILED DESCRIPTION OF THE PREFERRED EMBODIMENTS

Figure 1:
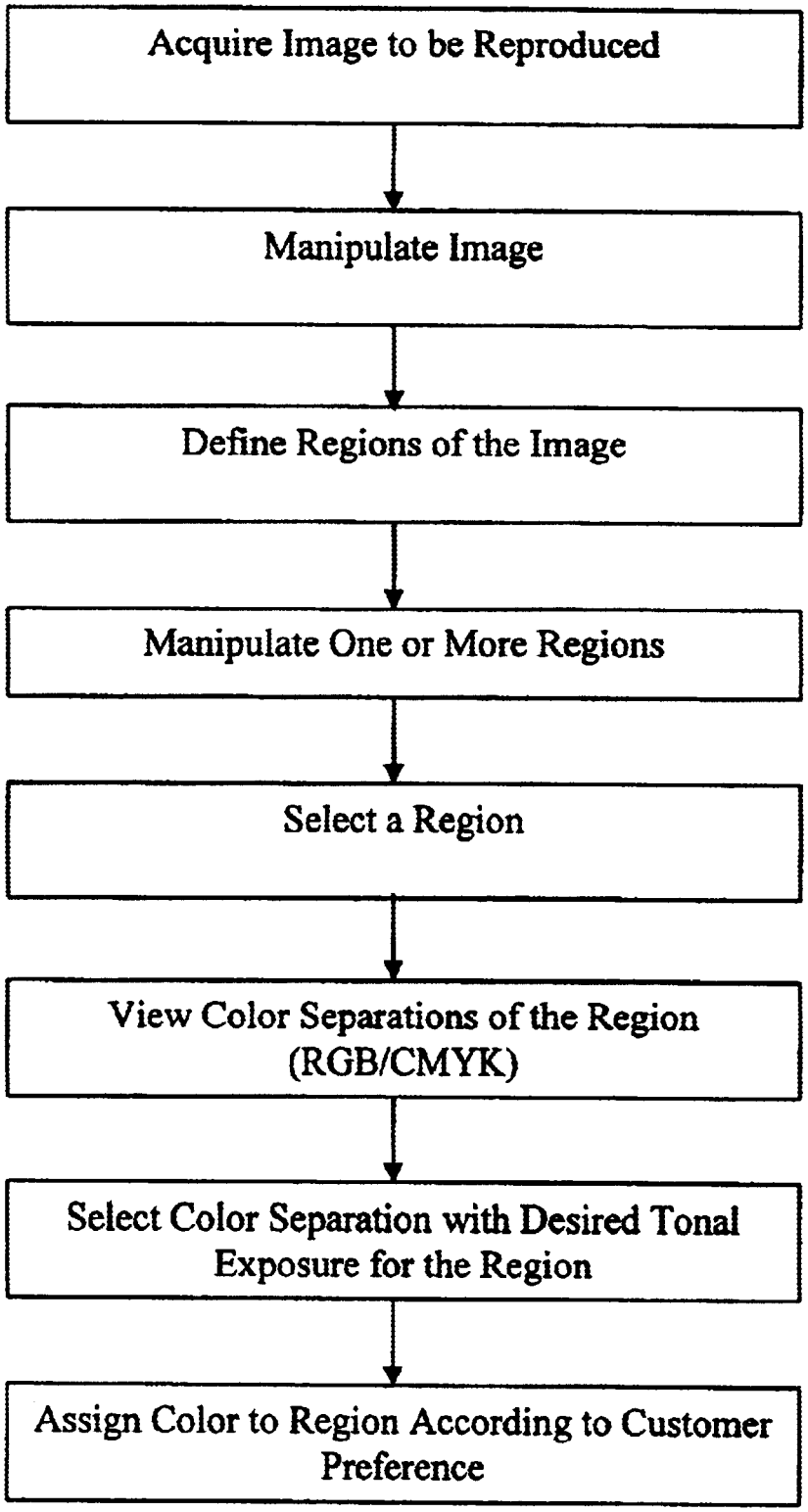
FIG. 1 is a flow chart illustrating one embodiment of the present invention.

The present invention relates to an improved method for printing an image on an object. The image to be created may be, for example, a logo, print, a photograph, a three-dimensional rendering, or the like. The color image may include any number or combinations of colors, preferably less than five. Letters or numbers may be present in, on top of, or around the image. Images may include varied colors, patterns, shading, or tones.

In a preferred embodiment, a method according to the present invention includes obtaining and manipulating the image in preparation for its reproduction. The image may then be defined into a plurality of regions, such as in a spot color process. Each of the plurality of regions may then be further manipulated as desired. After manipulating the image or any of the defined regions, a region may be selected. The selected region may be viewed through a set of filters. A filtered image of the selected region may be chosen based on the desired tonal exposure for the region. Finally, a color may be assigned to the selected region. As described above, one potential disadvantage of a spot color process is that the selection and balance of a color for any region may involve significant trial and error to obtain a desired result. In some, particularly difficult instances, this trial and error process may not result in obtaining a desired final image quality.

In a preferred embodiment, the image is a color image or logo. The color image may include any number or combinations of colors. Letters or numbers may be present in, on top of, or around the image. Images may include varied colors, patterns, shading, or tones.

In accordance with the present invention, an image can be printed onto any desired surface or object, for example, a ball or a shirt. The surface of the object may be comprised of any type of material, for example, paper, plastic, or metal. The properties of the surface can vary. For example, in some embodiments the surface may be convex, concave, dimpled, or flat. The present invention is capable of being used with different types of balls, for example, a tennis ball, a volleyball, or a basketball. As will be appreciated by those skilled in the art, the present invention may be used to print images on any desired surface or object.

Preferably, in accordance with the present invention, the image is viewed in the digital format using, for example, a computer. In some embodiments, the image may be drawn using a computer program. In other embodiments, the image may be obtained using a camera. The camera may store images digitally or using any type of film. Digital images can be uploaded to a computer. Images stored on film may be scanned into the computer using any type of scanning device. In other embodiments, an image may be hand drawn and then scanned into a computer. In alternate embodiments, images can be transferred to a desired computer, from a remote computer, via a modem or the Internet. Those skilled in the art will recognize that the image can be obtained using any apparatus or method desired.

In an alternate embodiment, the image does not have to be loaded onto a computer. An image may be printed onto a film, paper, or transparency. In these embodiments, a color image may be obtained using a camera. Preferably, in these embodiments, the images are taken using one or more filters. In other embodiments, the images can be drawn or painted onto the film, transparency or paper.

After an image is obtained, it may be manipulated in order to prepare it for subsequent processing. Manipulating the image may involve selectively using filters to produce the best possible image. In addition, characteristics such as hue may be adjusted. Parts of the image may be blurred or sharpened, and stray marks may be removed. In some embodiments, color saturation may be adjusted to provide an optimal image. In another embodiment, a program such as Adobe Illustrator may be used to clean up, edit, shape, form, or resize an image as desired. These are just examples. Those skilled in the art will realize that an image may be manipulated in a variety of ways.

Images may be defined into a plurality of regions using any method or apparatus. For example, in a preferred embodiment, a region may be defined using a computer program, for example, Adobe Photoshop or Adobe Illustrator. In programs such as this, regions can be defined on an image using a function that draws a box around a desired part of an image. The regions do not have to be distinct or continuous. In some embodiments, the regions may overlap. Any number of regions of an image can be defined, for example, between 1 and 20. More preferably, from 1 to 10 regions are defined. Most preferably, between 1 and 5 regions are defined. In some embodiments, this step may be eliminated or performed after subsequent steps.

The number of regions that are defined may be based on any set of criteria known to those skilled in the art. For example, in an exemplary embodiment, similarly shaded or colored parts of an image may be grouped into one region.

Regions of an image do not have to be separated from the rest of an image. For example, in a computer program such as Adobe Photoshop or Adobe Illustrator, a desired region may be isolated and subsequently manipulated without removing the region from the rest of the image. However, when using a computer program, a region may be isolated from the rest of an image when desired. In other embodiments, where an image is obtained using a camera and filters, as previously described, each region of an image may be isolated from the rest of the image.

An image may be manipulated based on a computer program such as Adobe Photoshop or Adobe Illustrator. Preferably, each region of an image is manipulated individually. As will be recognized by those skilled in the art, an image may be manipulated in a plurality of ways. For example, an image may be cleaned up by changing colors, adding text, defining edges, or removing parts of an image. In other embodiments, the shading, tone, gradient, or contrast may be manipulated. Preferably, an image is manipulated in order to obtain a more lifelike image, or to obtain optimal image quality or even tonality. A plurality of methods of manipulating images are well known to those skilled in the art. For example, a method for printing shaded logos on golf balls is described in U.S. Pat. No. 5,778,793, which is incorporated herein as reference.

A color can be assigned to each manipulated region as desired. In a preferred embodiment, after a color or colors is applied to each manipulated region, the image may be printed onto a golf ball. The image may be applied to a golf ball using any method. For example, color images may be applied to the golf ball based on pad printing, dye sublimation, an ink jet, a laser, or any other printing processes. The type of printing process used to apply an image to an object may depend on the texture, composition, shape, or size of the object. Alternately, the type of printing process used may depend on the colors, shading, tone, gradient, or contrast of an image.

In a preferred embodiment, the present invention comprises a method for printing color images on golf balls. The method includes defining a set of regions of the image. Each region of the image may then be viewed through a set of color filters. A user may determine which filter provides the greatest contrast of the desired part with respect to the complete image. Preferably, one predetermined color can then be added to each part of the complete image, as viewed through a desired filter. The color may be chosen based on the final desired color of the particular part of the image. Each part of the image, viewed through its respective filter, with its desired color applied, may then be assembled to re-create the original image.

Preferably, a computer program, for example, Adobe Photoshop and/or Adobe Illustrator, is used to implement the method according to the present invention. Although Adobe Photoshop and/or Adobe Illustrator may be used in a preferred embodiment, any image editor that supports color channels, for example, Corel Photo-Paint or Deneba Canvas, may be used. In other embodiments, the present invention may be implemented using manual methods, for example, through the use of transparencies. As will be appreciated by those skilled in the art, any method or apparatus capable of manipulating images may be used in accordance with the present invention.

Figure 2:
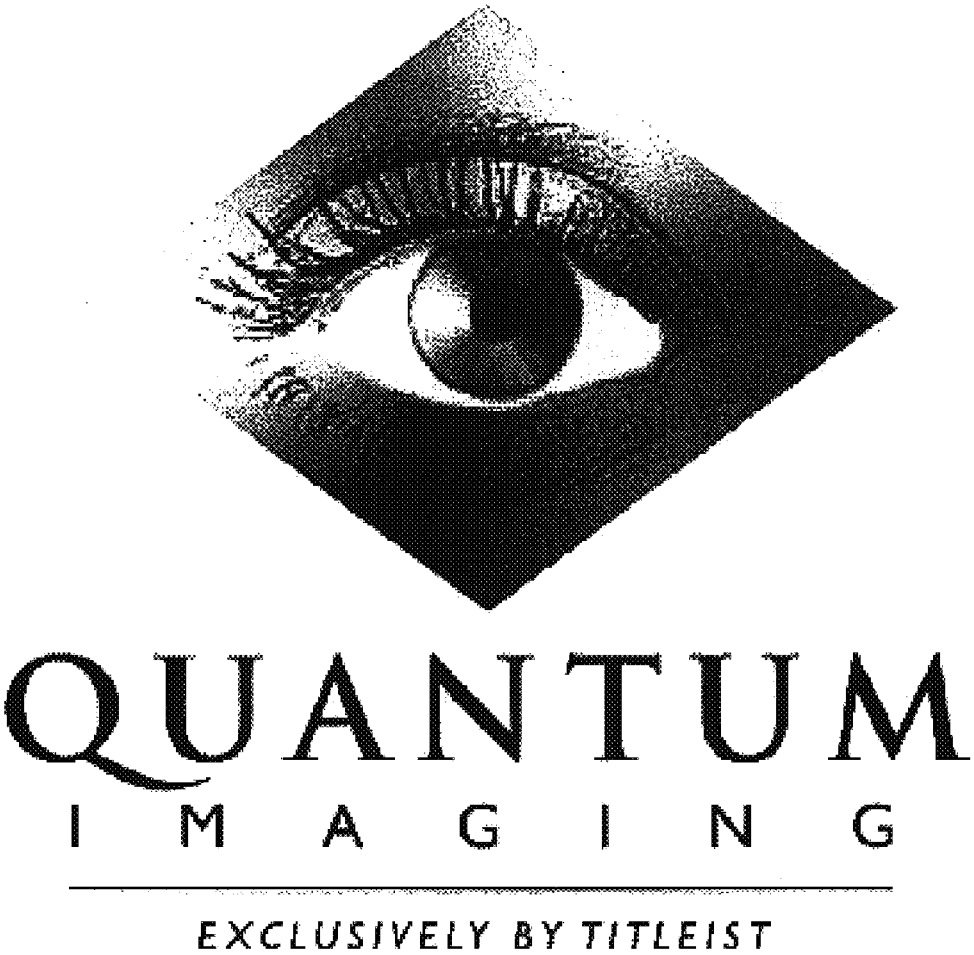
FIGS. 2*a–e* are diagrams showing an exemplary picture in accordance with the present invention.

FIG. 2*a* is a diagram showing an exemplary color picture in accordance with the present invention. In a preferred embodiment, the color picture may be viewed through a set of filters. The filters may include, for example, RGB filters or CMYK filters, both of which are well known to those skilled in the art. Preferably, one set of filters are used to view the image. However, in other embodiments it may be desirable to view a particular image using a combination of different sets of filters.

When the color image is viewed through a set of filters, the image will appear as separate gray monochromatic versions of the original image. FIGS. 2*b–e* show monochromatic versions of the original image shown in FIG. 2*a*. After separating the original image, a user may choose a specific region of the image, for example, the iris of the eye in FIG. 2*a*. The user may then determine which monochromatic image of the iris is most desirable. This can be determined based on several factors, for example, the contrast of the selected region with respect to the rest of the image. In addition, the desirability of a monochromatic image may be determined according to the other criteria discussed previously.

Figure 2B:
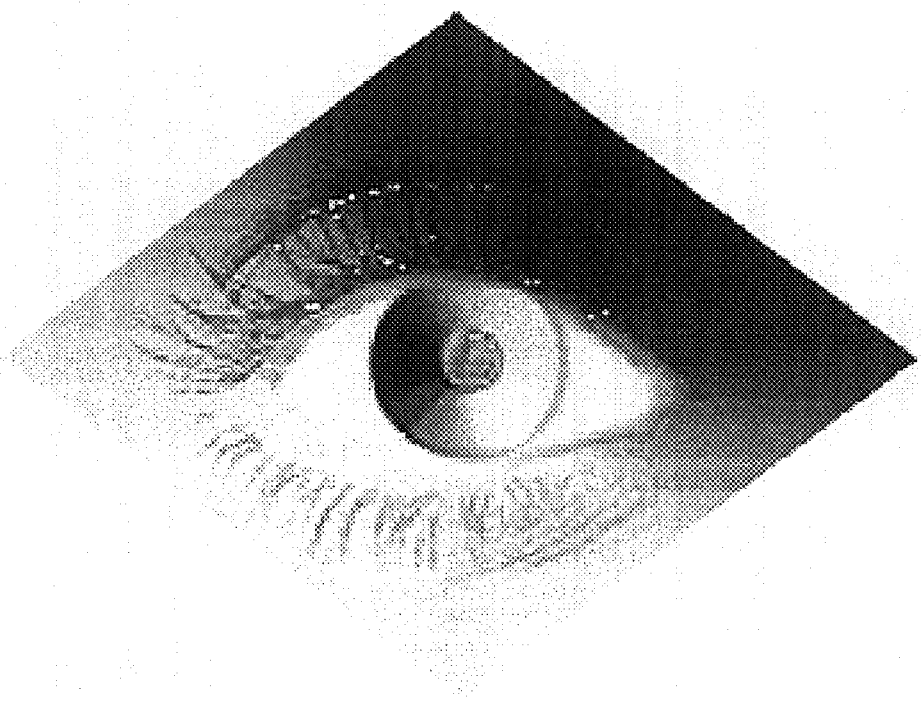
Figure 2C:
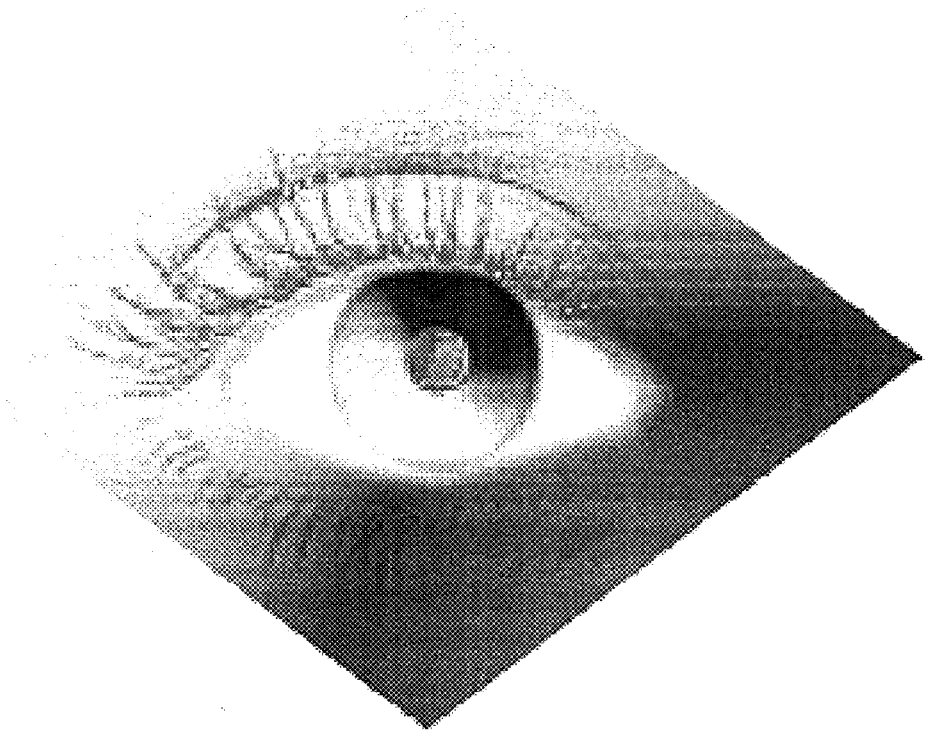
Figure 2D:
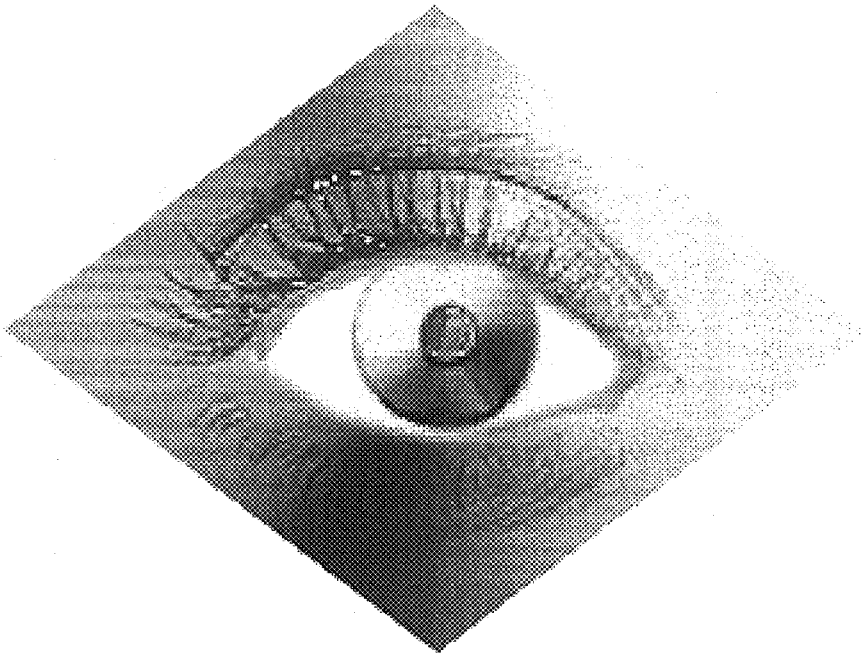
Figure 2E:
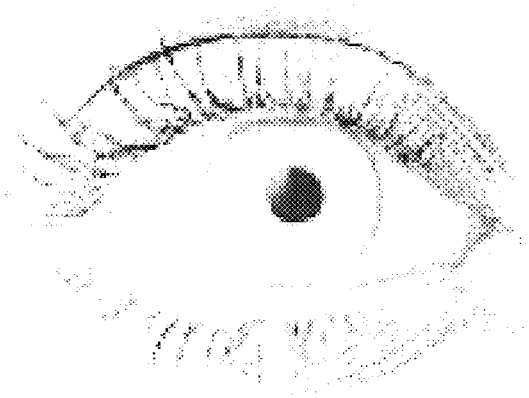

FIGS. 2*b–e* are diagrams showing FIG. 2*a* viewed through, black, cyan, magenta, and yellow filters, respectively. FIG. 2*b* hides the other channels, showing only a grayscale image comprised of the black filter data. Since the region of interest is the iris, a user determines if the iris is sufficiently contrasted with the rest of the image. This may be done. with respect to the other filtered images (FIGS. 2*b–e*) or the original image (FIG. 2*a*). In FIGS. 2*c–e,* the iris turns to a dark and muddy gray. However, in FIG. 2*b,* the iris appears to be clear. Compared to FIGS. 2*c–e,* the iris is the most visible, and has the greatest contrast with respect to the other parts of the image in FIG. 2*b*. Thus, for the iris, a user would choose the black filtered image, shown in FIG. 2*b*. In other embodiments, the filtered images of the iris shown in FIGS. 2*b–e* may be desirable. This can be determined according to a particular application based on the criteria discussed above.

In an exemplary embodiment, the image shown in FIG. 2*a* may be viewed using a RGB channel and a CYMK channel, simultaneously. For example, using an image editor such as Adobe Photoshop or Adobe Illustrator, the FIG. 2*a* image may also be separated into three channels using a RGB channel, and four additional channels using CYMK filters. By "flipping" between the RGB and the CYMK filtered images, a user may determine which filtered images provide the best quality for a desired region. Preferably, a user flips between the RGB and CYMK filters until a desired set is chosen. Once the set of filters is chosen, each region of the image is viewed using that set of filters. However, in an alternate embodiment, both sets of filters may be used. This embodiment allows a greater variety of filtered images from which to choose a desired monochromatic image. As will be appreciated by those skilled in the art, any type of filters may be used to separate a color image into a set of monochromatic images.

In the preferred embodiment, after a monochromatic image is chosen, a color may be applied to each region of the image. Any number or combination of colors may be applied to each region. Preferably, between 1 and 4 colors are assigned to each region. More preferably, between 1 and 3 colors are assigned to each region. Most preferably, a single color may be assigned to each selected part of the image. In a preferred embodiment, assigning a single color to each region allows the color of the region to be reproduced precisely and tonally accurate.

For example, as discussed above, FIG. 2*b* provides a monochromatic image that provides the greatest clarity and contrast of the iris with respect to the other parts of the image. In the preferred embodiment, the filtered image shown in FIG. 2*b* may be used to provide the iris. According to the present invention, a color, for example, blue, may then be applied to the iris.

In the preferred embodiment, the colored portion of the image, for example, the iris, may be isolated from the other portions of the image. This may be done using, for example, an image editor. The image editor may be used to erase or remove the undesired portions of the image. For example, in FIG. 2*b,* the eyelashes and eyelid may be removed or erased, leaving only the iris. A user would then determine which monochromatic image best highlights the iris, shown in FIG. 2*a*. Once a desired monochromatic image is chosen, the desired color of the iris may be applied to the monochromatic image. This can be repeated for each region of the image shown in FIG. 2*a*.

In an exemplary embodiment, each colored region may be "cut" and "pasted" to piece together a replica of the FIG. 2*a* image. The "cut" and "paste" functions are well known to those skilled in the art. In another embodiment, each colored region may be cut and pasted over the original FIG. 2*a* image using layers. In either embodiment, the new image may be saved and used as a template for printing the color image onto an object. Preferably, a pad printing process uses the template to print the object onto a golf ball. However, other printing processes known to those skilled in the art may be used.

Preferably, the image is printed onto a three-dimensional surface, such as golf ball. The surface of the golf ball may have any type of texture and may be made of any type of material. For example, the present invention can be used to print an image on the dimpled surface of a golf ball. In other embodiments, the golf ball surface may be smooth, have protruding members, or have a lattice of projections instead of dimples. The golf ball surface may be comprised of any type of material, such as thermoset or thermoplastic polyurethane, ionomer resins, or the like. Moreover, the image may be printed on top of another coating, such as a top coat for a finished golf ball. The texture of the surface of the golf ball may vary depending on the material used to form the golf ball.

The invention described and claimed herein is not to be limited in scope by the specific embodiments herein disclosed, since these embodiments are intended as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims.

What is claimed is:

1. A method for printing images on golf balls, comprising the steps of:

obtaining a first image;

defining a first region on said first image;

viewing color separations of the region;

selecting a color separation having desired tonal exposure for the first region;

modifying the first image by substituting the selected color separation for the first region;

assigning a first production print color to the selected color separation for the first region; and printing said first image onto a surface of a golf ball.

2. The method of claim 1, wherein the step of selecting a color separation comprises selecting a color separation from a Red, Green, or Blue filter.

3. The method of claim 1, wherein the step of selecting a color separation comprises selecting a color separation from a Cyan, Magenta, Yellow, or Black filter.

4. The method according to claim 1, wherein the step of printing the first image onto the golf ball comprises a spot color printing process.

5. The method of claim 4, further comprising the steps of:

defining a second region of the first image;

viewing color separations of the second region;

selecting a color separation having desired tonal exposure for the second region;

modifying the first image by substituting the selected color separation for the second region; and assigning a second production print color to the selected color separation for the second region.

6. The method of claim 1, wherein the step of printing the first image onto the surface of the golf ball comprises a pad printing process.

7. The method according to claim 1, further comprising the step of manipulating the first image by adjusting at least one of shading, gradient, contrast, opacity, or tone prior to the step of defining a first region on said first image.

8. A method for printing images on golf balls, comprising the steps of:

obtaining a first image;

defining a first region on said first image;

viewing color separations of the region;

selecting a color separation having desired tonal exposure for the first region, wherein the color separation is selected from a Red, Green, Blue filter or from a Cyan, Magenta, Yellow, or Black filter;

modifying the first image by substituting the selected color separation for the first region;

assigning a first production print color to the selected color separation for the first region; and printing said first image onto a surface of a golf ball.

9. The method according to claim 8, wherein the step of printing the first image onto the golf ball comprises a spot color printing process.

10. The method of claim 9, further comprising the steps of:

defining a second region of the first image;

viewing color separations of the second region;

selecting a color separation having desired tonal exposure for the second region;

modifying the first image by substituting the selected color separation for the second region; and assigning a second production print color to the selected color separation for the second region.

11. The method of claim 8, wherein the step of printing the first image onto the surface of the golf ball comprises a pad printing process.

12. The method according to claim 8, further comprising the step of manipulating the first image by adjusting at least one of shading, gradient, contrast, opacity, or tone prior to the step of defining a first region on said first image.

* * * * *